US012611606B1

(12) United States Patent
Medwed

(10) Patent No.: US 12,611,606 B1
(45) Date of Patent: Apr. 28, 2026

(54) PLUSH STUFFED WITH MOLDED OR SCULPTED FOAM

(71) Applicant: GennComm LLC, Tarzana, CA (US)

(72) Inventor: Jeremy Brian Medwed, Woodland Hills, CA (US)

( * ) Notice: Subject to any disclaimer, the term of this patent is extended or adjusted under 35 U.S.C. 154(b) by 119 days.

(21) Appl. No.: 18/537,868

(22) Filed: Dec. 13, 2023

Related U.S. Application Data

(63) Continuation-in-part of application No. 18/373,795, filed on Sep. 27, 2023, and a continuation-in-part of application No. 18/127,580, filed on Mar. 28, 2023, now Pat. No. 12,377,359, which is a continuation-in-part of application No. 17/406,191, filed on Aug. 19, 2021, now Pat. No. 11,623,156, which is a continuation-in-part of application No. 16/823,030, filed on Mar. 18, 2020, now Pat. No. 11,311,814, which is a continuation of application No. 16/564,118, filed on Sep. 9, 2019, now Pat. No. 10,596,475, which is a continuation of application No. 15/985,595, filed on May 21, 2018, now Pat. No. 10,427,061.

(60) Provisional application No. 63/411,161, filed on Sep. 29, 2022, provisional application No. 62/508,800, filed on May 19, 2017.

(51) Int. Cl.
*A63H 3/02* (2006.01)
*A63H 9/00* (2006.01)

(52) U.S. Cl.
CPC ..... *A63H 3/02* (2013.01)

(58) Field of Classification Search
CPC ... A63H 3/02; A63H 3/36; A63H 9/00; A63H 13/16; A63H 33/00
USPC ..... 446/73, 75, 226, 268, 369, 385
See application file for complete search history.

(56) References Cited

U.S. PATENT DOCUMENTS 2,760,302 A * 8/1956 Cheskin ..... A63H 33/00 221/56
2,952,462 A * 9/1960 Planin ..... A63H 33/00 446/385
3,354,578 A * 11/1967 Ryan ..... B29C 67/205 156/212
3,518,786 A * 7/1970 Holtvoigt ..... A63H 33/04 446/85
4,170,086 A * 10/1979 Hills ..... A63H 3/02 428/100

(Continued)

FOREIGN PATENT DOCUMENTS

EP 0206500 A1 * 12/1986 ..... B65D 85/07
GB 2110098 A * 6/1983 ..... A63H 9/00
GB 2309173 A * 7/1997 ..... A63H 9/00

OTHER PUBLICATIONS

NuLine Concepts Product Catalog.
www.temupedic.com/other-products/tempur-plush-teddy-bear/v/804.

*Primary Examiner* — Alexander R Niconovich
(74) *Attorney, Agent, or Firm* — Gugliotta & Gugliotta LPA

(57) ABSTRACT

A plush toy system is provided that incorporates strategically placed voids within its foam structure, allowing for increased compression and exceptional expansion potential. When compressed and contained within a package, the plush toy can be significantly smaller than its natural size, yet upon release, it expands beyond its natural dimensions, potentially exceeding 5 times its compressed size. This innovation revolutionizes the packaging and play experience of plush toys.

17 Claims, 6 Drawing Sheets

(56) References Cited

U.S. PATENT DOCUMENTS 4,233,775 A * 11/1980 Neufeld ..... A63H 3/04 446/370
4,505,687 A * 3/1985 Munro ..... A63H 3/02 446/385
4,629,441 A * 12/1986 Cahill ..... A63H 9/00 112/420
4,881,915 A * 11/1989 Liaw ..... A63H 13/02 446/385
4,936,460 A * 6/1990 Meyer ..... B65D 5/528 206/524.8
4,952,190 A * 8/1990 Tarnoff ..... A63H 3/00 446/385
5,009,626 A * 4/1991 Katz ..... B44C 1/1712 347/3
5,027,457 A * 7/1991 Sweet ..... A47G 9/1045 5/640
5,096,760 A * 3/1992 Thary ..... B32B 5/245 5/655.9
5,462,473 A * 10/1995 Sheller ..... A63H 3/36 446/183
5,488,907 A * 2/1996 Xu ..... B41F 16/02 347/3
5,496,026 A * 3/1996 Montgomery ..... A63B 43/002 473/600
5,503,584 A * 4/1996 Tulling ..... A63H 33/20 446/49
5,620,098 A * 4/1997 Boos ..... B65D 75/5805 206/524.8
5,895,308 A * 4/1999 Spector ..... A63H 3/02 446/183
5,897,418 A * 4/1999 Spector ..... A63H 3/06 446/268
5,961,363 A * 10/1999 Spector ..... A63H 3/06 446/385
6,126,510 A * 10/2000 Weiss, Jr. ..... A63H 3/02 446/431
6,261,146 B1 * 7/2001 Spector ..... A63H 33/00 446/385
6,264,526 B1 * 7/2001 Meeker ..... A63H 3/36 446/385
6,575,807 B2 * 6/2003 Spector ..... A63H 33/00 446/385
6,672,932 B1 * 1/2004 Panec ..... A63H 3/20 446/221
7,008,289 B2 * 3/2006 Norman ..... A63H 3/18 446/308
7,331,840 B2 * 2/2008 Amico, Jr. ..... A63H 9/00 446/369
7,682,216 B2 * 3/2010 Spector ..... A63H 33/38 281/31
7,730,853 B2 * 6/2010 Axelrod ..... B32B 3/263 119/709
7,887,386 B2 * 2/2011 Yu ..... A63H 3/02 446/72
7,887,387 B2 * 2/2011 Colvin ..... A63H 3/005 446/379
10,004,342 B2 * 6/2018 Waters ..... A47D 13/025
10,137,723 B2 * 11/2018 Bassett ..... B65D 81/203
10,576,390 B2 * 3/2020 Rosenbaum ..... A63H 3/02
12,343,651 B1 * 7/2025 Burneson ..... A61J 17/1111
12,440,774 B2 * 10/2025 Maldovan ..... A63H 3/02
2006/0054020 A1 * 3/2006 Dhillon ..... A61L 9/22 96/15
2007/0248940 A1 * 10/2007 Maguire ..... G09B 19/00 446/369
2008/0220688 A1 * 9/2008 Cuisinier ..... A63H 3/005 446/73
2010/0237542 A1 * 9/2010 Zhang ..... A63H 9/00 264/342 R
2011/0217900 A1 * 9/2011 Lai ..... A63H 9/00 446/369
2013/0017756 A1 * 1/2013 Lai ..... A01K 15/025 446/369
2013/0288567 A1 * 10/2013 Blue ..... A63H 3/02 446/268
2014/0364034 A1 * 12/2014 Lee ..... A63H 3/003 446/297
2015/0290546 A1 * 10/2015 Alves ..... A63H 3/02 446/369
2019/0038982 A1 * 2/2019 Clark ..... A63H 3/04
2022/0192339 A1 * 6/2022 Rotundo ..... A63H 33/00
2025/0058237 A1 * 2/2025 Maldovan ..... A63H 3/02
2025/0222369 A1 * 7/2025 Freitas ..... A63H 3/003

* cited by examiner (c) 2020 GennComm, LLC

PLUSH STUFFED WITH MOLDED OR SCULPTED FOAM

COPYRIGHT NOTICE

Pursuant to 37 C.F.R. 1.71(d)-(e)(1988), a portion of the disclosure of this patent document contains material which is subject to copyright protection. The copyright owner has no objection to the facsimile reproduction by any one of the patent document or the patent disclosure, as it appears in the Patent and Trademark Office patent file or records, but otherwise reserves all copyright rights whatsoever.

RELATED APPLICATIONS

Applications of related continuity are further disclosed as part of the Application Data Sheet filed pursuant to 37 C.F.R. § 1.76. All Related Applications are incorporated by reference as if fully rewritten herein.

BACKGROUND OF THE INVENTION

1. Field of the Invention

This invention relates to plush toys, and more particularly to a compressible viscoelastic or memory-foam based plush toy.

2. Description of the Related Art

Plush toys are well known and have been a favorite style of toy for generations. Traditional plush toys are not easily compressed, however, for the purpose of reducing their shipping and storage size, and/or to conceal their expanded shape, without damaging the plush toy and permanently deforming it. Traditional polyester fiberfill and wool are used in the prior art, but such fill for a plush toy does not enable the plush toy to be compressed without damage and expand into its original shape.

Therefore, there is a need for a system that allows a plush toy to be compressed to less than its normal, expanded size without permanently deforming the plush toy or changing its shape when subsequently expanded to its natural size. Such a needed invention could include a package that is either a different shape than the final shape of the plush toy, promoting surprise and mystery for the end user of such a system, or that resembles the shape of the plush toy but in a miniature form, or that includes a plurality of such plush toys placed into a product displayed quickly (PDQ) box or tray, or in other ways. Such a needed invention would be relatively inexpensive to manufacture, transport, and store. The present invention accomplishes these objectives.

SUMMARY OF THE INVENTION

It is thus objects of the present invention to provide an improved plush toy and a method for making such an improved plush toy.

It is a feature of the present invention to provide such a plush toy that is stuffed with molded or sculpted compressible viscoelastic or memory-foam.

The invention comprises a plush toy system with a foam inner structure designed to compress efficiently for packaging purposes and expand dramatically when deployed. The foam inner includes voids, strategically placed within its structure, facilitating both increased compression for decreased package size and extraordinary expansion potential upon release. The foam inner can be manufactured through injection molding or shaping a foam block into a character shape, with the voids incorporated during production. A flexible outer covering surrounds the foam inner, creating the plush toy. The outer covering is smaller than the natural size of the foam inner, enabling the compression process. The package for this plush toy system has at least one open side through which the toy is compressed and inserted. Upon opening the package, the plush toy begins to expand, and its expansion is not limited to its natural size. This unique feature enhances the surprise and anticipation for users as the toy expands well beyond its compressed dimensions.

The plush toy system may also include additional features for sensory enhancement during play. Embossing the foam with textures or using a foam inner composed of various foams with distinct properties and textures creates a diverse tactile experience for users.

It is an advantage of the present invention to provide a plush toy can be compressed significantly below its natural size, which in some cases may reduce packaging costs and storage space, and in other cases to merely increase the size, texture or effect of the plush toy.

Another advantage of the present invention is the inclusion of open spaces or voids formed within the foam structure, thereby allowing the plush toy expands dramatically and providing an exciting and surprising experience for users. With strategically placed voids within its foam structure, the compression, packaging, and expansion of plush toys provides a unique user experience, especially for large form factor products.

Other variations in the foam inner are further anticipated. By way of example, the foam inner may be a mixture of different foams having different properties to give different textures, or create a movement of effect or the like.

According to additional embodiments, the present system may include a package having at least one open side through which the plush toy traverses when compressed to fill an interior space of the package. The package may be a rectanguloid, a two-piece ovaloid, or the like. Preferably the foam inner is stored in a compressed size less that of its natural, expanded size when unconstrained by the package. According to one aspect of such additional embodiments, when vacuum sealing the product the orientation of the vacuum sealed item will determine the products vacuum sealed size (for example, by folding a bear in half and subsequently placing within a packaging that will be vacuum sealed, thereby almost halving the product size packaged size). Such an orientation when vacuum sealed also can add an effect to the unboxing or unwrapping as the foam self-reinflates with air when the package is opened. In such an embodiment the plush toy will not only self-inflates but also unfolds itself while doing it.

In use, when the plush toy is compressed and contained within the package, and upon opening of the at least one open side the plush toy at least partially expands out of the at least one open side of the package. When removed completely from the package the plush toy expands to the natural size of the plush toy.

The present invention is a plush toy that can be compressed below it normal size, or size and shape such as to allow for expansion its natural size when deployed. The present system may include a package that is either a different shape than the final shape of the plush toy, promoting surprise and mystery for the end user of such a system, or that resembles the shape of the plush toy but in a miniature form, or that includes a plurality of such plush toys placed into a point-of-purchase display box or tray, or in other ways. Any of the various implementations of the present invention are relatively inexpensive to manufacture, transport, and store.

Further and other objects, features, elements and advantages of the present invention will become apparent from the following more detailed description, taken in conjunction with the accompanying drawings, which illustrate, by way of example, the principles of the invention.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

Figure 1:
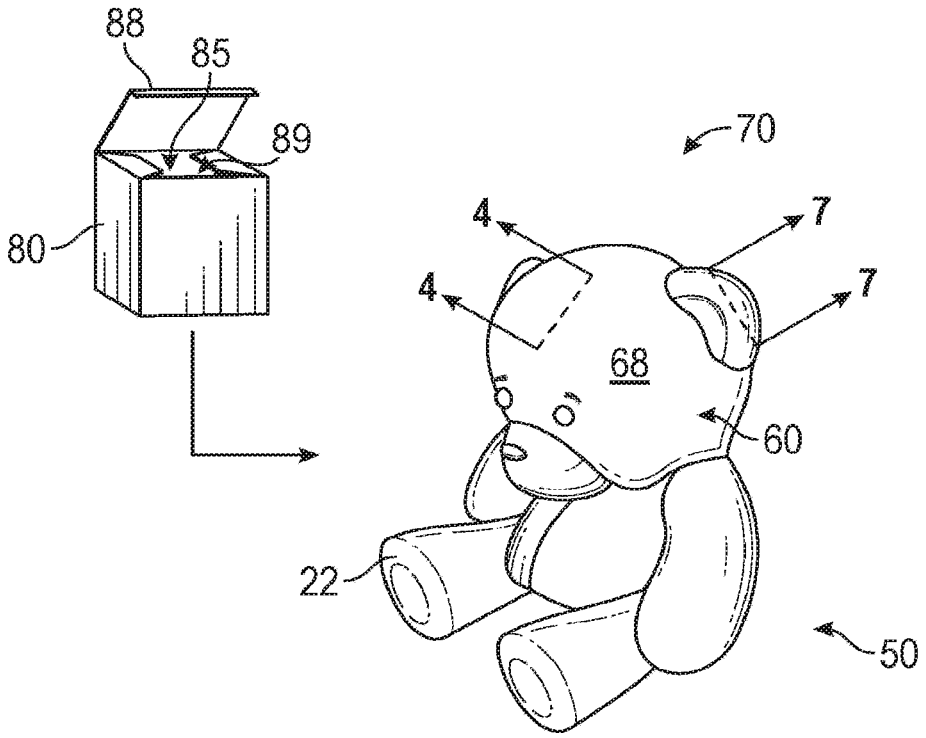
FIG. 1 is an exploded perspective view of the invention, illustrating a plush toy expanded to a natural size after being removed from a package of the invention.
Figure 2:
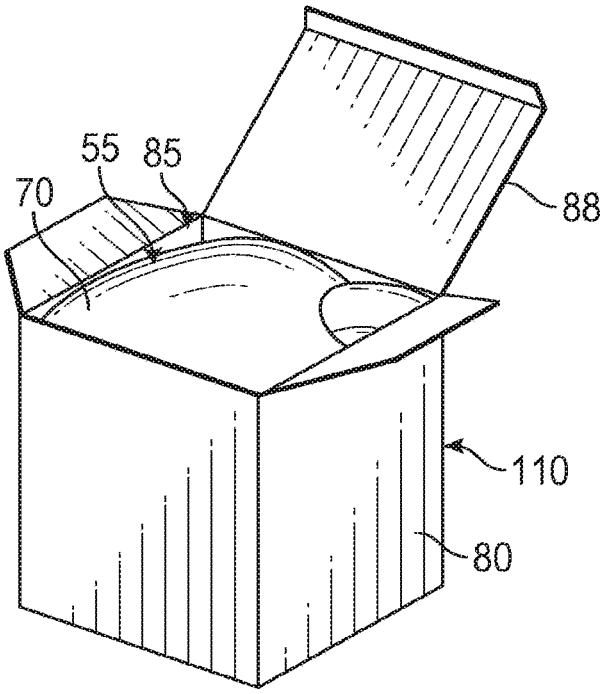
FIG. 2 is a perspective view of the invention, illustrating the plush toy as contained in the package just as the package is opened.
Figure 3:
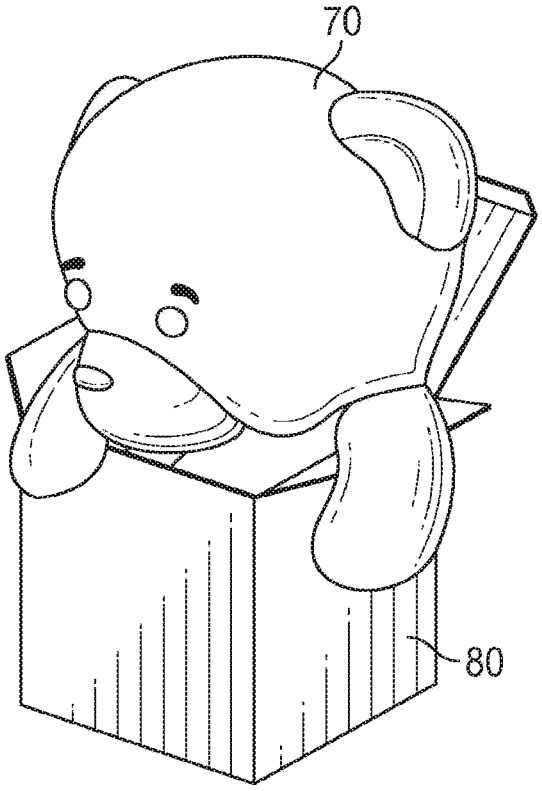
FIG. 3 is a perspective view of the invention, illustrating the plush toy expanding out of the package after the package is opened.
Figure 4:
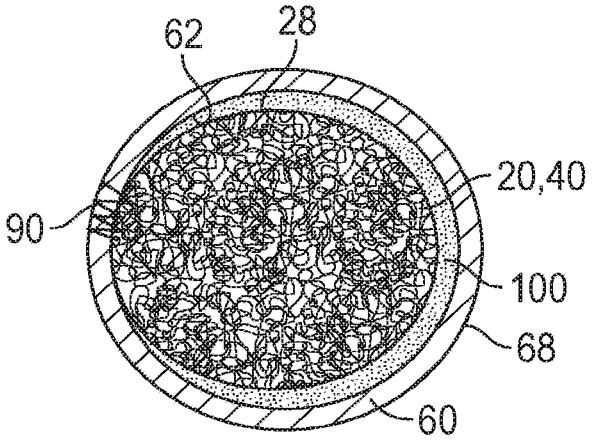
FIG. 4 is a cross-sectional view of the plush toy taken generally along line 4-4 of FIG. 1, illustrating a foam inner with an outer covering.
Figure 7:
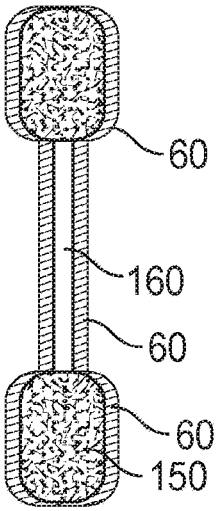
FIG. 7 is a cross-sectional view of an appendage of the plush toy having traditional fiberfill stuffing and/or no stuffing taken generally along line 7-7 of FIG. 1.
Figure 5A:
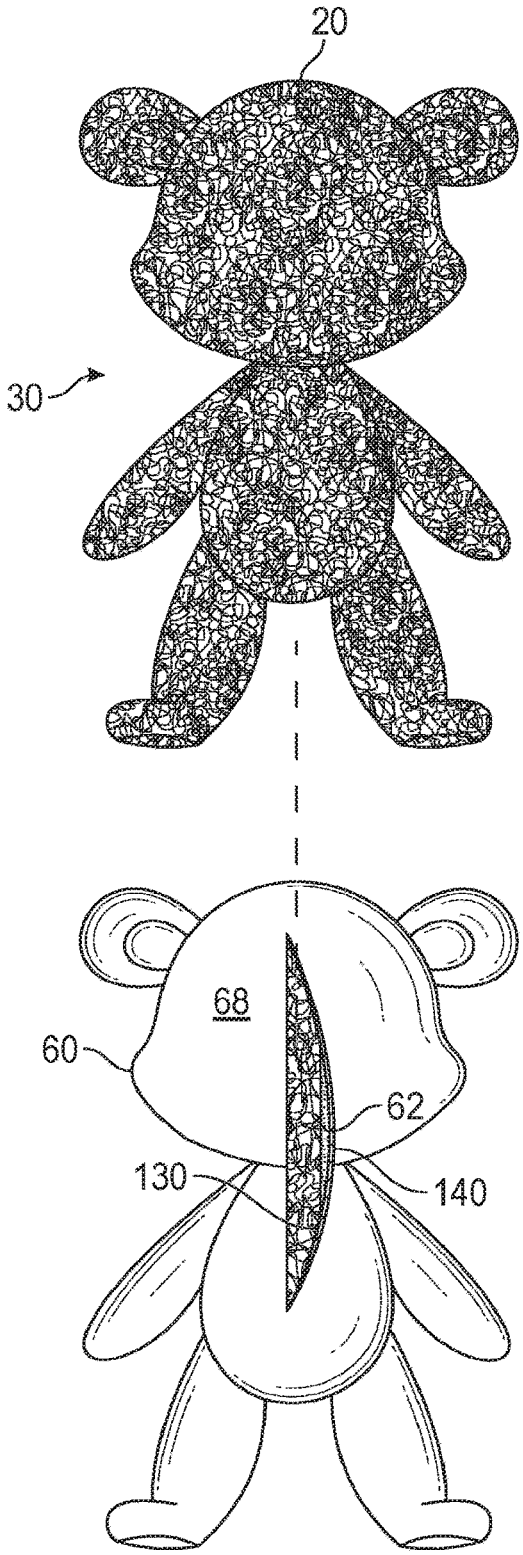
FIG. 5A is a front exploded elevational view of the foam inner, fully expanded to its natural size, and a flexible outer covering into which the foam inner is inserted.
Figure 5B:
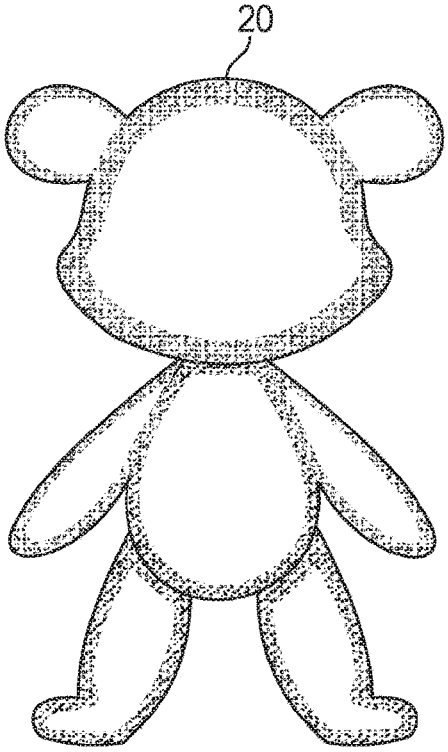
FIG. 5B is a cross-sectional view of a rear half of an alternate embodiment of the foam inner, illustrated with central hollow portions.
Figure 5C:
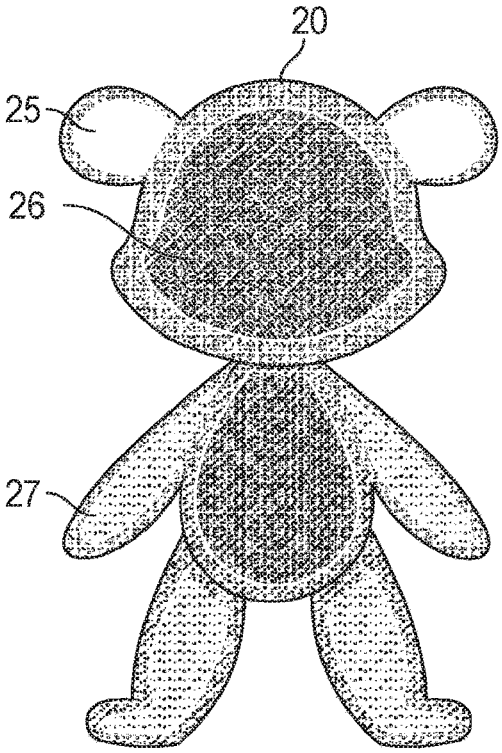
FIG. 5C is a cross-sectional view of a rear half of another alternate embodiment of the foam inner, illustrated with central hollow portions.
Figure 6A:
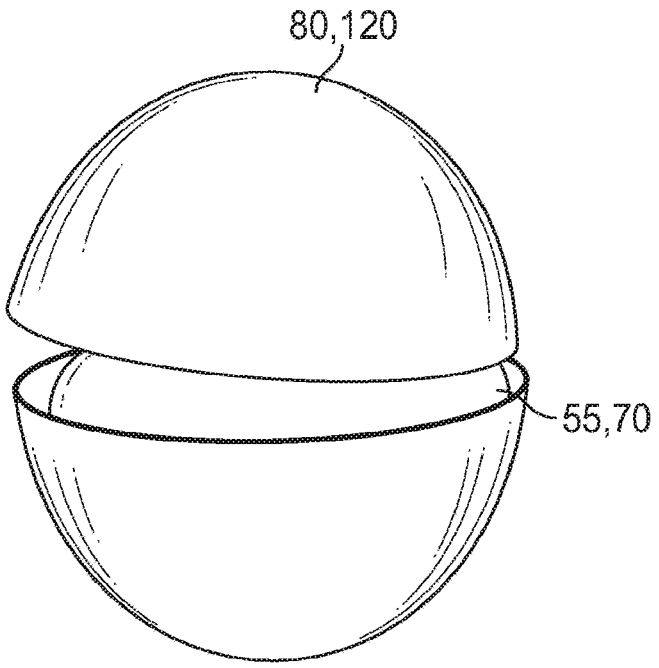
FIG. 6A is a perspective view of an alternate package of the invention, illustrated in a partially open position.
Figure 6B:
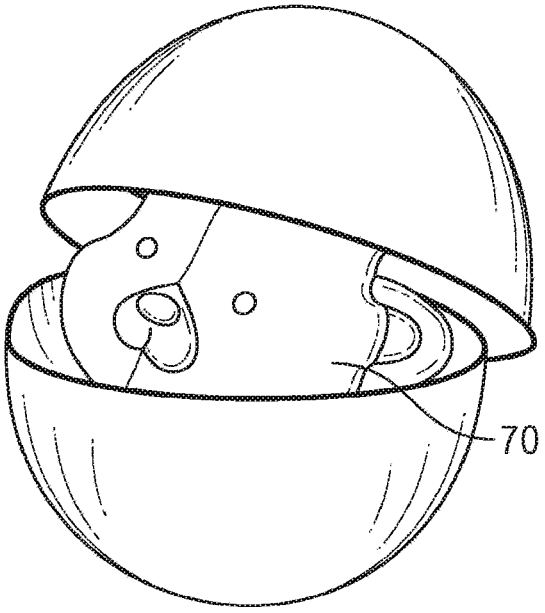
FIG. 6B is a perspective view of the embodiment of FIG. 6A, shown slightly more open and with the plush toy starting to expand towards its natural size.
Figure 6C:
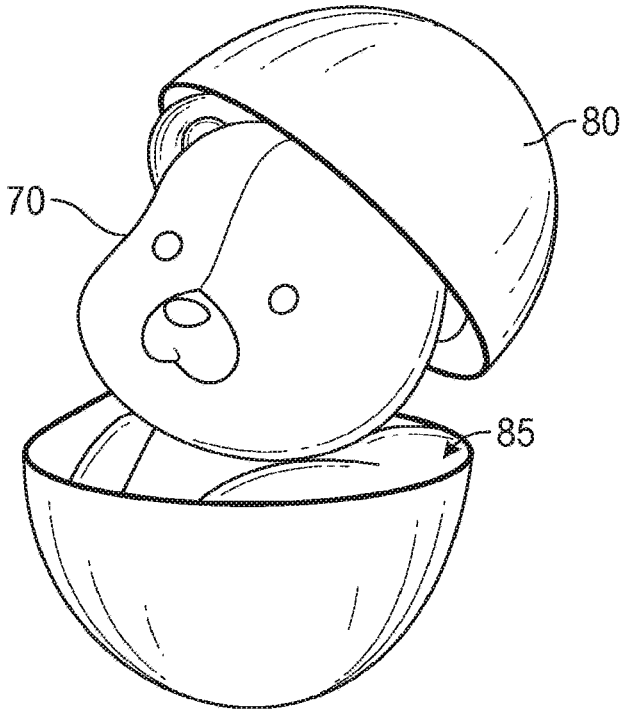
FIG. 6C is a perspective view of the embodiment of FIG. 6B, shown even more open and with the plush toy continuing to expand towards its natural size.
Figure 6D:
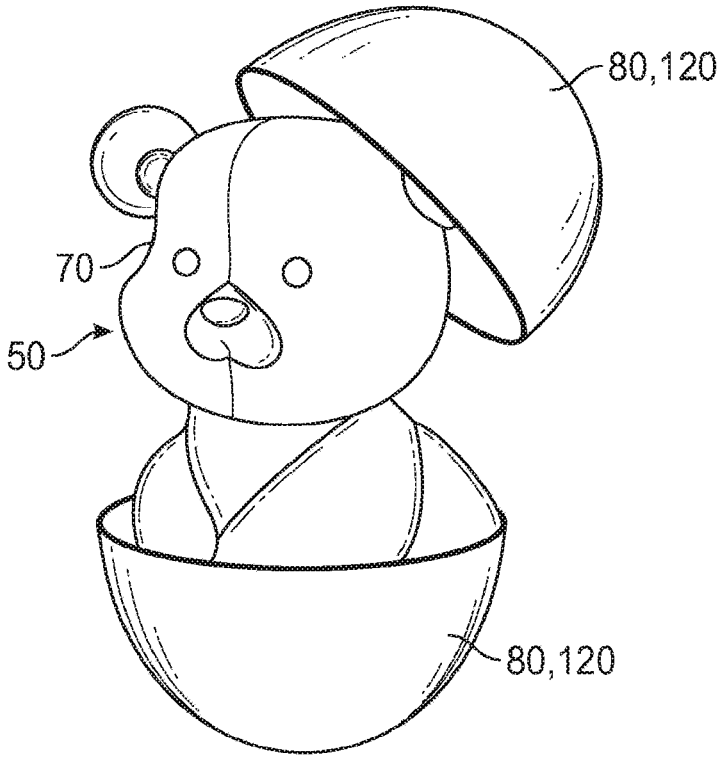
FIG. 6D is a perspective view of the embodiment of FIG. 6C, shown more fully open and with the plush toy continuing to expand towards its natural size.

The best mode for carrying out the invention is presented in terms of its preferred embodiment, herein depicted within the Figures. It should be understood that the legal scope of the description is defined by the words of the claims set forth at the end of this patent and that the detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims.

Before explaining the present invention in detail, it is important to understand that the invention is not limited in its application to the details of the construction illustrated and the steps described herein. The invention is capable of other embodiments and of being practiced or carried out in a variety of ways. It is to be understood that the phraseology and terminology employed herein is for the purpose of description and not of limitation.

For purposes of the present disclosure the terms "a" and "an" herein do not denote a limitation of quantity, but rather denote the presence of at least one (1) of the referenced items. Further for purposes of the present disclosure the terms "in", "out", "left" "right", "up" or "down" are all spatial and functionally relative directions used to aid in the description to best explain the principles of the invention and its practical application, and to aid others skilled in the art to best utilize the invention and are not meant to be limiting to any particular orientation. It should also be understood that, unless a term is expressly defined in this patent there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning.

For purposes of the present disclosure the term "foam" is to be broadly construed. The term "foam" may include high, medium and/or low density latex based foam, either open or closed cell. The term "foam" may also include high, medium and/or low density polyurethane foam, either open or closed cell. The term "foam" may include high, medium and/or low density vinyl/nitrile (or "PVN") based foam, either open or closed cell. The term "foam" may include high, medium and/or low density polyvinyl chloride (or "PVC") based foam, either open or closed cell. The term "foam" may include high, medium and/or low density polyethylene terephthalate (or "PET") based foam, either open or closed cell. The term "foam" may further include a natural based foam, such as Mycoflex™ available from Ecovative Design LLC of Green Island, NY or other similar or equivalent mycelium based foam, either high, medium and/or low density foam, open or closed cell. Such natural based foams may be made biodegradable, natural, compostable and safe for children or pets. Additionally, while the use of "open cell" foams may not otherwise be strictly considered "memory" foam, such open cell foams may be utilized for embedding and/or to mix with other foam types.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words 'herein", "above", "below" and words of similar import, when used in this application, shall refer to this application as a whole and not to any particular portions of this application. When the claims use the word "or" in reference to a list of two or more items, that word covers all of the following interpretations of the word: any of the items in the list; all of the items in the list; and any combination of the items in the list. When the word "each" is used to refer to an element that was previously introduced as being at least one in number, the word "each" does not necessarily imply a plurality of the elements, but can also mean a singular element.

Finally, unless a claim element is defined by reciting the word "means" and a function without the recital of any structure, it is not intended that the scope of any claim element be interpreted based on the application of 35 U.S.C. § 112(f).

The best mode for carrying out the invention is presented in terms of its preferred embodiment, herein depicted within the Figures.

1. Detailed Description of the Figures

Referring now to FIG. 1 through 8, a plush toy system is illustrated, comprising a foam inner 20 formed into a character shape 30, such as a doll, animal, or other character shape. The foam inner 20 comprises an outer surface 28. Unlike conventional foam, the foam inner 20 in this embodiment includes strategically placed voids, as described in greater detail below, allowing for increased compression (resulting in decreased package size) and an exceptional expansion potential, exceeding five times its compressed size. Importantly, the walls of these voids are structurally substantial enough to support the intended shape of the character 30. Such a foam inner 20 can be manufactured using an injection molding process or by cutting and shaping a foam block into the character shape 30, incorporating these voids during the manufacturing process.

A flexible outer covering 60 surrounds the foam inner 20 and is sized in at least one dimension to be smaller than the natural size 50 of the foam inner 20. In some embodiments, the outer covering 60 may be sized substantially the same as the natural size 50 of the foam inner 20 (FIG. 5A) but slightly smaller than the natural size of the foam inner 20. The outer cover 60 has an inner surface 62 for contacting the foam inner 20 and an outer surface 68. The foam inner 20 and the flexible outer covering 60 combine to form a plush toy 70. The covering 60 may include a flap 130 through which the foam inner 20 may be inserted during manufacturing of the plush toy 70. A closure 140, such as a zipper, hook-and-loop type fastener, mechanical snaps, or the like, may be employed to close the flap 130 to seal the foam inner 20 inside the outer covering 60.

In preferred embodiments, at least a portion of the inner surface 62 of the outer covering 60 is fixed with the outer surface 28 of the foam inner 20 using stitching 90, adhesive 100 (FIG. 4), ultrasonic welding (not shown), or similar methods. The outer covering 60 is preferably made with either a 2-way stretch material or 4-way stretch material, such as rayon, lycra, or other suitable web materials like woven or non-woven fabric, vinyl sheet material, or the like.

The system may also preferably include a package 80 having at least one open side 85 through which the plush toy 70 traverses when compressed to fill an interior space 89 of the package 80. The package 80 may come in various forms, such as a rectanguloid 110 (FIGS. 1-3), including a cube-shaped package 80, or a two-piece ovaloid 120 (FIGS. 6A-6D) with the open side 85 exposed when separating the two pieces. At least one package closure 88, such as a paper flap, may be included for selectively sealing the at least one open side 85. In such embodiments, the end consumer may not know the character shape 30 of the plush toy 70 when opened, adding an air of mystery to the system. Alternatively, the package 80 may resemble a miniature version of the character shape 30, giving an idea of the final shape of the plush toy 70 when opened.

As described in greater detail below, in use, the plush toy 70 is compressed and contained within the package 80. Upon opening of the at least one open side 85, the plush toy 70 at least partially expands out of the at least one open side 85 of the package 80 and, when completely removed from the package 80, expands to the natural size 50 of the plush toy 70.

In some embodiments, the foam inner 20 includes one or more appendages 22 (or other sections, portions or pieces) that include and form voids 16, which can remain empty or be filled with various materials such as synthetic stuffing, natural stuffing, compressible foam, wool, polyester fiberfill, feathers, or beads. Alternatively, appendages 22 or other hollow portions 25 could be made that include no fill, such as an ear of a character that remains relatively flat. Additionally, appendages 22 or other hollow portions 25 could be made with foam material 40 having different expansion rates, or a mix of foam material 40 to create varying effects upon release of the plush toy 70 from its compressed size 55.

For example, in some embodiments, the foam inner 20 is comprised of at least two types of compressible foam material 40 that have different natural expansion rates. Portions 26 of the foam inner 20 with a quicker expansion rate reach their natural size 50 more rapidly than other portions 27 with foam material 40 having a slower expansion rate. Therefore, based on the size and composition of the various appendages 22 and foam material 40 used, the foam inner 20 may be designed so that all portions of the character shape 30 achieve their natural size 50 at approximately the same time when released from their compressed size 55.

By way of example, and not as a limitation, the compressible foam material 40 may include a viscoelastic, temperature sensitive foam. Such a "memory" foam is currently used otherwise for in mattress applications in the existing art. Such a foam material 40 may be provided having the physical property described in Table 1 below.

TABLE 1

| Quality | Property |
|---|---|
| Nominal Piece Density Range | 48-52 kg/m3 |
| Nominal Hardness (40%) Strength | 70-100N |
| Nominal Tensile Strength | 50 kPa min. |
| Nominal Elongation at Break | 180%. |
| Resilience | 16% max. |
| Recovery rate | 5-20 secs. |
| Compression set (50%) | 12% max. |

Figure 8:
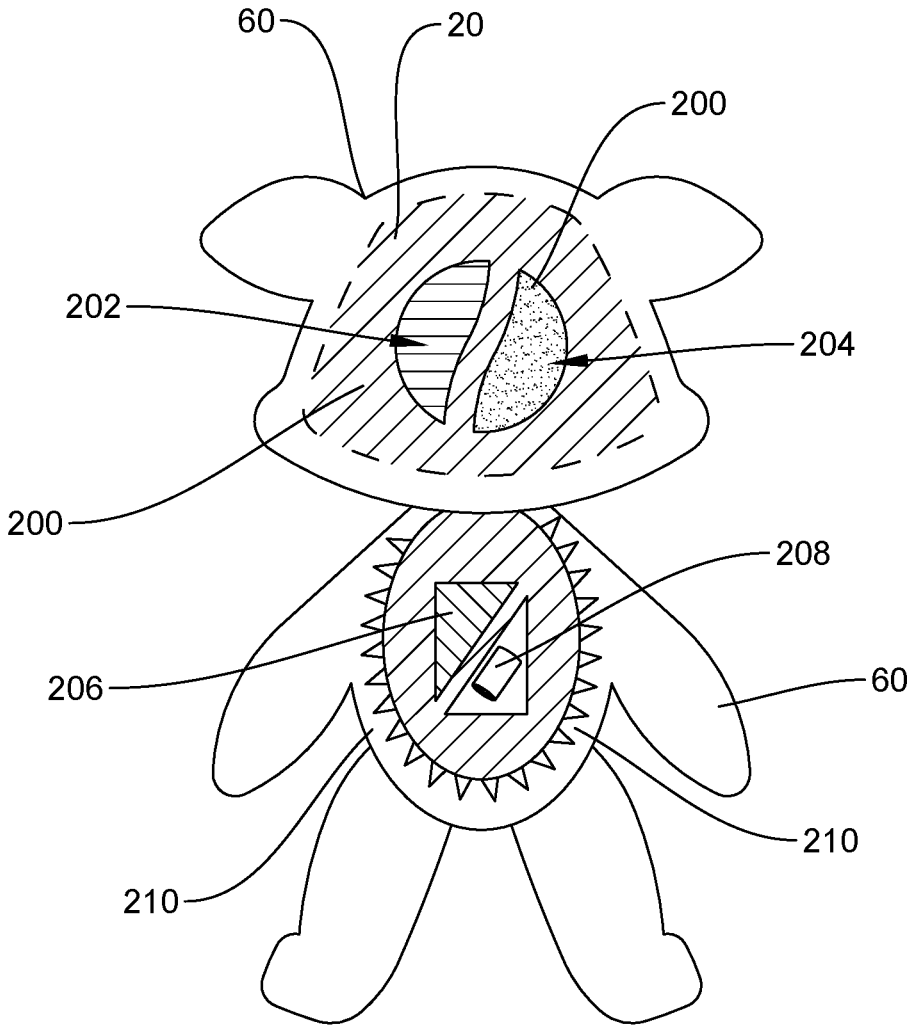
FIG. 8 is a cross-sectional view of a rear half of yet another alternate embodiment of the foam inner, illustrated with variations of additional functional augmentation.

In various embodiments, the foam inner may further incorporate a number of additional features to augment its functionality. For example, FIG. 8 depicts an exemplary embodiment of the present invention demonstrating several variations of functional augmentation 200. The foam inner 20 may include a filled bladder 201 containing a liquid 202 or non-Newtonian fluid 204, which can include soap, chemical liquid, or other liquids with differing viscosities, enhancing tactile experiences. Alternatively, one or more cavity or void 206 formed within the foam inner 20. By includes voids strategically placed within its structure, both increased compression for decreased package size and extraordinary expansion potential upon release. Further, with the incorporate of multiple voids or large void the increased compression and/or decreased package sized can be scaled to a much larger form factor by, potentially, orders of magnitude. The foam inner 20 or voids 206 may further incorporate a tactile toy or other tactile physical device 208, including motorized devices or audible/tactile electronics embedded within the foam inner 20. The inclusion of these tactile response components within the foam inner 20 not only augments the foam structure but also modifies the interaction of such embedded items, enhancing the overall sensory experience. By creating variations in the foam inner 20, using a mixture of different foams with different properties, textures, or movement effects can be achieved.

Finally, the foam inner 20 may further incorporate a texture 210 onto its surface in the form of ridges, bumps, grooves, or any other shape that imparts a textured feel through the outer covering 60, enhancing the tactile experience for users 2. Operation of the Preferred Embodiment In operation, the present invention, with its foam inner incorporating strategically placed voids for increased compression and an extraordinary expansion potential, is compressed and contained within the package. Upon opening of the at least one open side, the plush toy begins to expand, and this expansion is not limited to the natural size of the plush toy alone. Due to the presence of voids within the foam, the plush toy can expand well beyond its initial compressed size, potentially exceeding 5 times its compressed size.

When completely removed from the package, the plush toy expands to not only its natural size but can expand significantly beyond, thanks to the voids within the foam structure. With the plush toy initially compressed below its normal size, or size and shape, the toy is allowed to expand dramatically when deployed.

After deployment, the incorporation of any additional functions or features within the foam inner provides an additional sensory input during play. For instance, embossing the foam itself with a texture imparts a differential feel through the outer cover and to the outside of the plush toy. Furthermore, the use of a foam inner composed of a mixture of different foams with varying properties, textures, or movement effects can further enhance the sensory impressions, creating a rich and engaging tactile experience for users.

The foregoing descriptions of specific embodiments of the present invention are presented for purposes of illustration and description. The Title, Background, Summary, Brief Description of the Drawings and Abstract of the disclosure are hereby incorporated into the disclosure and are provided as illustrative examples of the disclosure, not as restrictive descriptions. It is submitted with the understanding that they will not be used to limit the scope or meaning of the claims. In addition, in the Detailed Description, it can be seen that the description provides illustrative examples and the various features are grouped together in various embodiments for the purpose of streamlining the disclosure. This method of disclosure is not to be interpreted as reflecting an intention that the claimed subject matter requires more features than are expressly recited in each claim. Rather, as the following claims reflect, inventive subject matter lies in less than all features of a single disclosed configuration or operation. The following claims are hereby incorporated into the Detailed Description, with each claim standing on its own as a separately claimed subject matter.

The claims are not intended to be limited to the aspects described herein, but is to be accorded the full scope consistent with the language claims and to encompass all legal equivalents. Notwithstanding, none of the claims are intended to embrace subject matter that fails to satisfy the requirement of 35 U.S.C. § 101, 102, or 103, nor should they be interpreted in such a way. Any unintended embracement of such subject matter is hereby disclaimed. They are not intended to be exhaustive nor to limit the invention to precise forms disclosed and, obviously, many modifications and variations are possible in light of the above teaching. The embodiments are chosen and described in order to best explain principles of the invention and its practical application, to thereby enable others skilled in the art to best utilize the invention and its various embodiments with various modifications as are suited to the particular use contemplated. It is intended that a scope of the invention be defined broadly by the Drawings and Specification appended hereto and to their equivalents. Therefore, the scope of the invention is in no way to be limited only by any adverse inference under the rulings of *Warner-Jenkinson Company*, v. *Hilton Davis Chemical,* 520 US 17 (1997) or *Festo Corp.* v. *Shoketsu Kinzoku Kogyo Kabushiki Co.,* 535 U.S. 722 (2002), or other similar caselaw or subsequent precedent should not be made if any future claims are added or amended subsequent to this Patent Application.

What is claimed is:

1. A plush toy system comprising:

a foam inner structure formed with one or more strategically placed voids facilitating increased compression and exceptional expansion potential, wherein walls of said voids are structurally substantial enough to support a structure of an intended shape, and wherein said foam inner structure comprises viscoelastic memory foam having a recovery rate of 5-20 seconds;

a flexible outer covering surrounding the foam inner structure; and the foam inner structure being smaller than a natural uncompressed size when enclosed within the outer covering.

2. The plush toy system of claim 1, wherein the foam inner structure is manufactured through injection molding or by shaping a foam block into a character shape, with the voids incorporated during production to create specific compression ratios and expansion patterns not achievable with solid foam construction.

3. The plush toy system of claim 1, further comprising a sensory enhancement element selected from a group consisting of tactile toys, electronic devices, and textured inserts positioned within the foam inner structure or within a void to provide enhanced user interaction during an expansion process.

4. The plush toy system of claim 1, further comprising a package with at least one open side, through which the plush toy system can be compressed and inserted.

5. The plush toy system of claim 4, wherein said package is configured to tightly enclose and compress the plush toy system;

wherein upon removal of the plush toy system from the package, the foam inner structure expands, driven by the strategically placed voids, reverting the plush toy system closer to its natural uncompressed size without requiring relief of vacuum pressure.

6. The plush toy system of claim 1, further including a package having at least one open side through which the plush toy system traverses when compressed to substantially fill an interior space of the package, whereby when the plush toy system is compressed and contained within the package, upon opening of the at least one open side, the plush toy system expands out of the at least one open side of the package, and when removed completely from the package the plush toy system expands to a shape defined by the outer covering.

7. A plush toy system comprising:

a foam inner formed of a compressible foam material having an outer surface and having a recovery rate of 5-20 seconds, the foam inner having a natural size when unconstrained;

one or more strategically placed voids formed within the foam inner, wherein said voids enable expansion potential exceeding five times a compressed size; and a shape defining textile fabric outer covering surrounding at least a portion of the foam inner wherein the covered portion of foam inner is compressed and constrained by the textile fabric outer covering such that the inner foam does not achieve a natural, uncompressed size or shape.

8. The plush toy system of claim 7, further comprising an insert having at least one first physical property different than a same physical property of the foam inner, wherein said insert is positioned within one of said strategically placed voids.

9. The plush toy system of claim 7, wherein said foam inner further comprises an insert comprising a retainer having a filling selected from a group consisting of: a liquid; a non-Newtonian fluid; a molding compound; a play slime; a malleable play material; a secondary foam element; a tactile toy; a tactile physical device; a motorized device; an audible electronic device; and a tactile electronic device, wherein said insert is positioned within one of said strategically placed voids and enhances tactile user interaction during compression and expansion cycles in a manner not achievable through mechanical spring deployment.

10. The plush toy system of claim 9, wherein said foam inner further comprises a texture onto an outer surface of the foam inner, said texture imparting a tactile feel through the outer covering, wherein said texture is integrally formed with the foam inner structure and interacts with the strategically placed voids to create variable tactile sensations during compression and expansion cycles that are not achievable with removable discrete stuffing components.

11. The plush toy system of claim 7, wherein said foam inner is a high density, medium density or lower density foam formed of a material selected from a group consisting of: viscoelastic foam; polyurethane foam; vinyl/nitrile or PVN based foam; polyvinyl chloride or PVC based foam; polyethylene terephthalate or PET based foam; and a mycelium based foam, wherein said foam inner is specifically configured for compression and expansion cycles rather than athletic throwing and bouncing applications.

12. The plush toy system of claim 11, wherein said foam inner further comprises an open cell foam or a closed cell foam having void-based compression characteristics that enable expansion potential exceeding five times compressed size, distinguishing it from athletic ball foam compositions designed for controlled rebound characteristics.

13. The plush toy system of claim 12, wherein said foam inner is biodegradable or compostable.

14. The plush toy system of claim 11, wherein said foam inner is biodegradable or compostable.

15. The plush toy system of claim 7, wherein the shape defining textile fabric outer covering surrounds the foam inner entirely.

16. The plush toy system of claim 7, wherein:

the foam inner further forms a shape having more than one section or appendage; and said strategically placed voids are formed within the foam inner at one or more of any of the more than one section or appendage, wherein said strategically placed voids in said appendages provide differential expansion rates between different sections of the plush toy system.

17. The plush toy system of claim 7, further including a package having at least one open side through which the plush toy system traverses when compressed to substantially fill an interior space of the package, whereby when the plush toy system is compressed and contained within the package, upon opening of the at least one open side, the plush toy system expands out of the at least one open side of the package, and when removed completely from the package the plush toy system expands to a shape defined by the outer covering.

* * * * *